US006261116B1

(12) United States Patent
Ceru

(10) Patent No.: US 6,261,116 B1
(45) Date of Patent: Jul. 17, 2001

(54) CONNECTOR POSITION ASSURANCE ELEMENT WITH LOCK PROTECTION FEATURE

(75) Inventor: Scott Joseph Ceru, Livonia, MI (US)

(73) Assignee: Yazaki North America, Inc., Canton, MI (US)

( * ) Notice: Subject to any disclaimer, the term of this patent is extended or adjusted under 35 U.S.C. 154(b) by 0 days.

(21) Appl. No.: 09/447,031

(22) Filed: Nov. 22, 1999

(51) Int. Cl.[7] ..... H01R 13/627
(52) U.S. Cl. ..... 439/352; 439/489; 439/353
(58) Field of Search ..... 439/352, 489, 439/353, 350

(56) References Cited

U.S. PATENT DOCUMENTS

| | | | |
|---|---|---|---|
| 4,946,404 | 8/1990 | Takenouchi et al. | 439/352 |
| 4,950,179 | 8/1990 | Takenouchi et al. | 439/352 |
| 5,030,127 | 7/1991 | Blasko et al. | 439/353 |
| 5,120,255 | 6/1992 | Kouda et al. | 439/489 |
| 5,330,369 | 7/1994 | Nozaki et al. | 439/489 |
| 5,507,666 | 4/1996 | Yamanashi | 439/489 |
| 5,803,651 * | 9/1998 | Saito | 403/329 |
| 5,879,180 * | 3/1999 | Iwahori et al. | 439/352 |
| 6,045,388 * | 4/2000 | Higgins et al. | 439/352 |

* cited by examiner

*Primary Examiner*—Gary F. Paumen
*Assistant Examiner*—Alexander Gilman
(74) *Attorney, Agent, or Firm*—Young & Basile, P.C.

(57) ABSTRACT

A connector position assurance (CPA) element and lock arm structure for mating connector housings in which the CPA element has three-stage insertion and two-stage withdrawal with complementary locking and release-preventing engagement with the lock arm and connector housing in each of the positions. The CPA element is first inserted partway underneath the lock arm on the first housing to a pre-set position in which it is not easily removed from the housing. The connector with the pre-set CPA element is next inserted into a second connector housing, in which the CPA element is released from the pre-set position to a pre-locked position. The CPA element can then be fully inserted underneath the lock arm from the pre-locked position to a fully-locked position in which it provides both a visual indication of complete connector mating and strengthens the locking engagement between the connector housings.

13 Claims, 5 Drawing Sheets

FIG-4
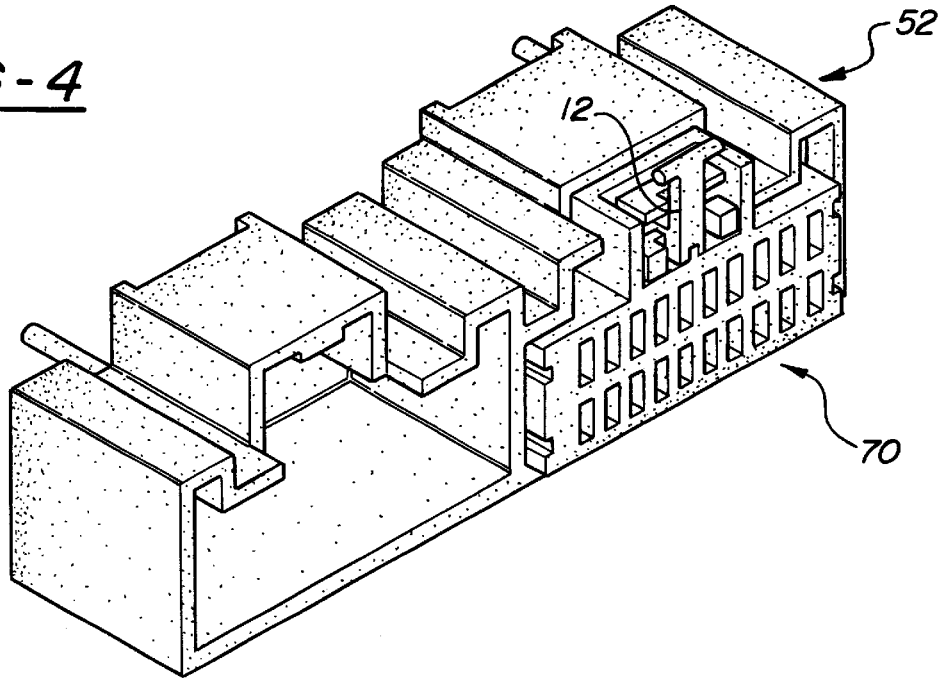
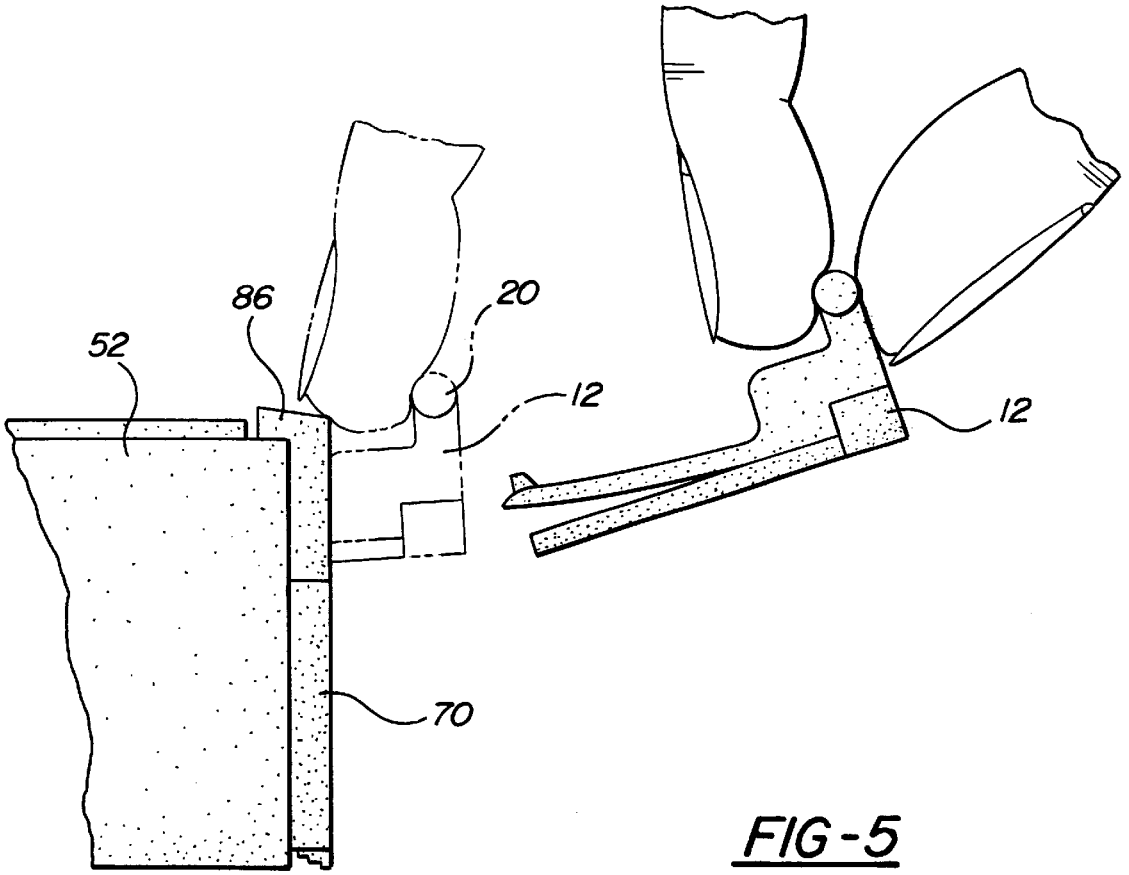
FIG-5

CONNECTOR POSITION ASSURANCE ELEMENT WITH LOCK PROTECTION FEATURE

FIELD OF THE INVENTION

The present invention is in the field of connector position assurance elements for mated male and female electrical connector housings.

BACKGROUND OF THE INVENTION

Male and female electrical terminal connector housings are often provided with releasable locking structure to lock them in their fully engaged position. The locking structure frequently takes the form of a flexible lock arm on one of the housings with a finger-operable release tab. This locking engagement is typically performed on automated assembly lines, and the housings must be checked to see if they are fully engaged. Accordingly, an additional part known as a "CPA" or connector position assurance element is sometimes used in the assembly process to detect or assure this locking engagement, indicating complete electrical connection of the terminals.

A first type of CPA element is pre-locked to one of the housings in association with the locking structure on that housing. When that housing is properly and fully engaged with the other housing, the CPA element is released from its pre-locked engagement with the one housing and can be withdrawn. The absence of this CPA or "detecting spacer" indicates a properly locked connector. An example of such a detecting spacer is disclosed in U.S. Pat. No. 5,330,369 to Nozaki et al.

A different type of CPA is shown in U.S. Pat. No. 5,120,255 to Kouda et al. A CPA in the form of a lock detecting slider is partway mated with a male connector, and the male connector is subsequently inserted into a female connector. When the male and female connectors are in complete electrical connection, the slider can be advanced to a lock indicating position where a mark on the slider can be viewed through an opening in the locking mechanism on the male connector.

A further type of CPA member is disclosed in U.S. Pat. No. 4,946,404 to Takenouchi et al. A CPA is mounted on a male connector in a pre-engaging position. A female connector releases flexible fingers on the pre-engaged CPA as the connectors mate, and the CPA member can then be further pushed to engage the female connector. The CPA then enhances the locking connection between the male and female connectors, while a base portion of the CPA prevents a male connector lock arm from being unintentionally released.

U.S. Pat. No. 5,030,127 to Blasko et al. discloses a male connector lock arm with a built-in release-preventing member in the form of a T-shaped thumb pad which prevents the connector arm from being accidentally disengaged by virtue of elevated guard surfaces on either side of the thumb pad. This lock arm does not use a separate CPA-type member as in the above-described patents.

SUMMARY OF THE INVENTION

The present invention is a mating connector lock arm and CPA structure, in which the CPA functions in three stages to assure the complete connection of a female connector housing with a male connector housing and to prevent a lock arm on one of the housings from being accidentally disengaged.

The CPA is designed for use with a two-part connector system comprising male and female connector housings. In an exemplary form, the female housing has a flexible, detent-type lock arm which snaps into place over mating locking structure on the male housing. An outer operating tab on the lock arm can normally be depressed to release the locking engagement between the two connector housings.

The CPA is first preferably placed in a pre-set position on the female housing before the male housing is mated with the female housing. In this pre-set position the CPA cannot be moved into further engagement with the lock arm, nor can it be easily withdrawn.

As the male housing is mated with the female housing, lock arm engaging structure on the male housing moves the CPA on the female housing to a neutral position in which the housings are locked and the lock arm structure normally preventing the CPA from being further inserted is bypassed. This can be described as a pre-locked condition.

Finally, the CPA can be pushed into a full-locked position in which 1) the visually-observable relationship of the CPA to the operating tab on the end of the lock arm proves terminal connection, 2) the operating tab on the lock arm cannot be depressed so as to disengage the locking connection between the male and female housings, and 3) accidental release of the CPA itself from the full-locked position is prevented by a surrounding protective well and by a removal-hindering connection between the CPA and the lock arm and female housing.

The CPA can be removed in two stages, but only by deliberately grasping the CPA and overcoming a frictional interference with the lock arm until the CPA is partway removed to a pre-removal position. From this pre-removal position (in which the CPA is out of engagement with the lock arm operating tab) the CPA can then be fully removed, but only by pulling it up and out in an arcuate motion different from the motion used to withdraw the CPA from the full-locked to the pre-removal position.

In a preferred form, the CPA itself looks like a three-pronged "sled", having two flat outside prongs and an upwardly-curved or angled middle prong. The "rear" end of the "sled" comprises a vertically-extending, generally T-shaped operating handle. The underside of the CPA preferably includes a channel with an internal detent for engaging a portion of the female housing.

The female housing includes an integral, flexible lock arm secured at its interior end to the housing and having an exterior, free end terminating in a finger-operated release tab. In the CPA pre-set position, the underside detent on the CPA slides over and snaps down on a mating detent on the female housing, while a pawl on the forward end of the middle CPA prong abuts a transverse stop bar on the lock arm. Further advancement of the CPA requires the female connector housing to be fully inserted into a male housing, in which a portion of the male housing forces the transverse stop bar in the lock arm down; rides over the depressed stop bar, which then pops back up into locking engagement with the male housing; and, finally rides over and depresses the pawl on the middle prong of the CPA, thereby forcing it down below the transverse stop bar and allowing the CPA to be further inserted to its full-engaged position. At this point the middle prong of the CPA pops back up on the opposite side of the transverse stop bar to positively lock the CPA to the female housing. At the same time, the T-shaped operating handle on the CPA drops into a notch formed in the operating tab, and a shoulder on the CPA slides underneath the operating tab to prevent the tab from being depressed.

These and other features and advantages of the invention will become apparent upon further reading of the specification in light of the accompanying drawings.

BRIEF DESCRIPTION OF THE DRAWINGS

FIG. 4 illustrates the CPA further engaged with the mated male and female housings, in a CPA full-locked position preventing operation of a lock arm operating tab on the female housing;

FIG. 5 illustrates in broken and solid lines the outward and upward, arcuate motions in which the CPA element can be deliberately removed from its full-locked position of FIG. 4 via an operating handle on the CPA;

DETAILED DESCRIPTION OF THE ILLUSTRATED DESCRIPTION

Figure 1:
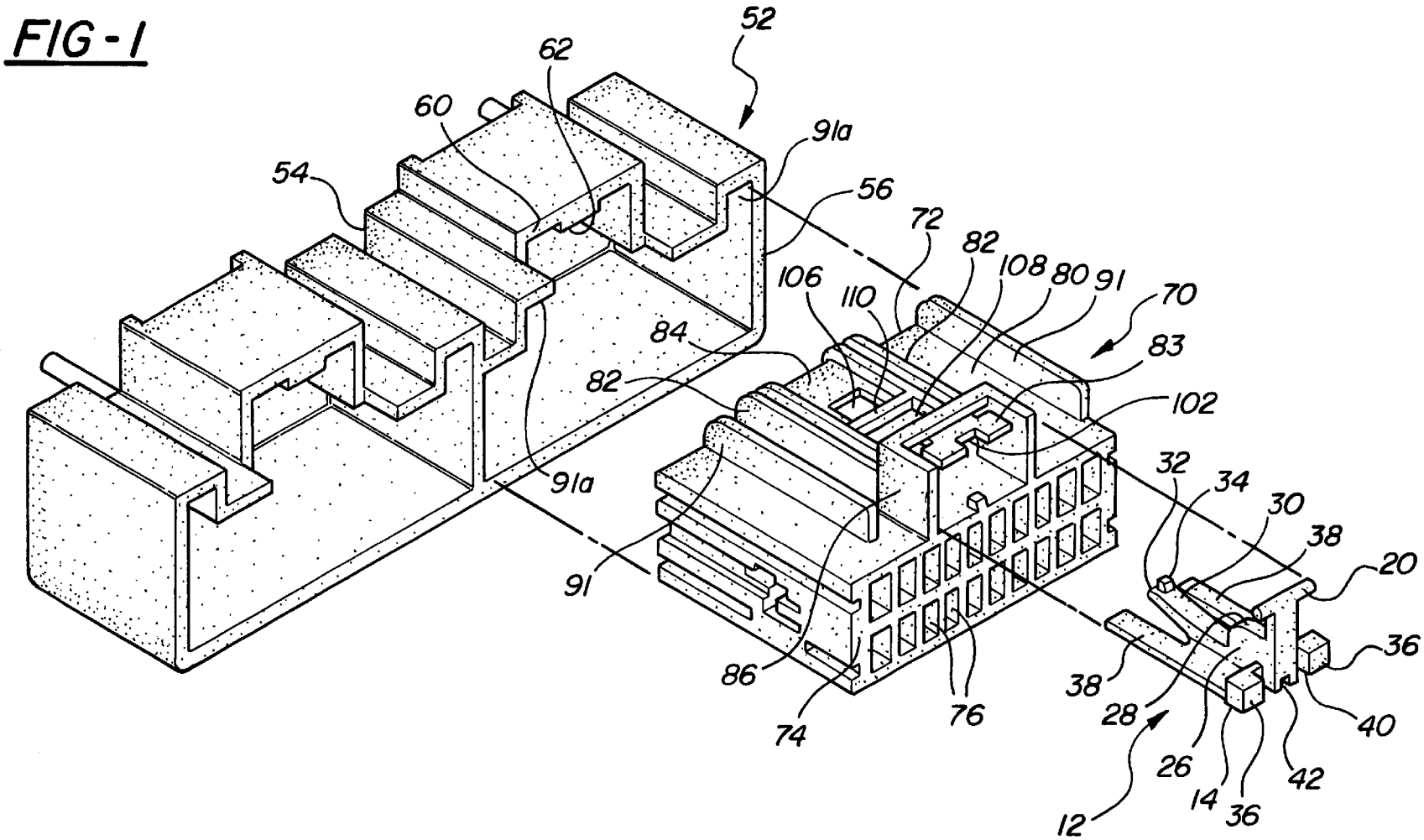
FIG. 1 is a rear, perspective, exploded view of a female connector housing, a male connector housing, and a CPA element according to the invention.

Referring now to FIG. 1, a one-piece, plastic connector position assurance (CPA) element 12 has a base portion 14 and a T-shaped handle 20 extending at a right angle from the base portion. Handle 20 is joined to base 14 by a forwardly-extending shoulder 26 forming a seat 28 approximately midway along the height of the T-shaped handle.

A flexible middle arm or prong 30 extends forwardly from base 14 in alignment with shoulder 26. Middle prong 30 is bent or curved upward, as generally depicted by the orientation of the Drawings, to a free end 32. A pawl 34 protrudes upwardly from prong 30 just inward of the free end.

Base portion 14 has two raised blocks 36 on each side of handle 20 and shoulder 26 at the rear end of CPA 12. Two outer guide arms 38 extend forwardly from base 14 parallel to and on each side of prong 30. The outer guide arms, however, are relatively flat. An underside 40 of the CPA has a narrow channel 42 extending forwardly to the base of prong 30. A beveled detent 44 is located in the channel near prong 30, effectively dividing the channel into a short part 46 and a long part 48 best shown in FIGS. 6 and 7.

The CPA element 12 is designed for use with mating male and female connector housings. In the illustrated embodiment of FIG. 1, an exemplary male connector housing 52 has a first end 54 and a second end 56. The first end 54 has terminal passages 58 for receiving known types of male electrical terminals (not shown) in known manner. The second end 56 is open to form the entrance to an inner cavity for receiving a female connector housing. An upper wall 60 of the male connector housing has a centrally located, rectangular protrusion or boss 62 extending downwardly into the cavity adjacent the second end 56 of the housing.

A mating female connector housing 70 has a first end 72 and a second end 74. Female terminal accommodating chambers 76 extend through the housing. Deflectable latches of known type in chambers 76 secure female terminals (not shown) within the chambers in conventional manner. The female connector housing 70 has a top wall 80 on which is formed a cantilevered lock arm 84 for securing the female housing 70 within the male connector housing 52 by way of locking engagement with boss 62.

The terms "male" and "female" are applied to the connector housings herein in accordance with the nature of the terminals they carry, and not the shape or mating nature of the housings themselves. The terms could of course be reversed without affecting the scope or operation of the invention. The invention is believed to be applicable to both "male" and "female" housings which mate generally in the fashion depicted, i.e. the lock arm on one connector sliding under and mating with a protrusion or boss on the other connector.

The illustrated lock arm 84 is located between rigid parallel guides 82. Guides 82 terminate rearwardly at a raised rectangular well 86 surrounding an operating tab 83 on the free end of lock arm 84.

The lock arm 84 is joined to the top wall 80 of female housing 70 adjacent first end 72. The lock arm extends rearwardly in flexible, cantilever fashion to operating tab 83, which is connected to but elevated from arm 84 by an upward ramp-like or step-like portion. The outer (rearward) edge of tab 83 has a rectangular slot or notch 102. Three-sided well 86 leaves only the upper surface of the tab accessible by finger. On the top wall of the female housing beneath tab 83, directly under notch 102, is a small protuberance or nub 104.

Lock arm 84 has two rectangular apertures in its upper surface: a first, smaller, forward aperture 106 and a second, larger, rearward aperture 108 separated from forward aperture 106 by a narrow bridge portion 110. The bridge portion 110 is elevated from the plane of forward aperture 106 and on the same level as rearward aperture 108. The rearward aperture 108 extends to tab 83 and forms an axial opening at its junction with the tab when viewed from the rear of the female housing.

Figure 2:
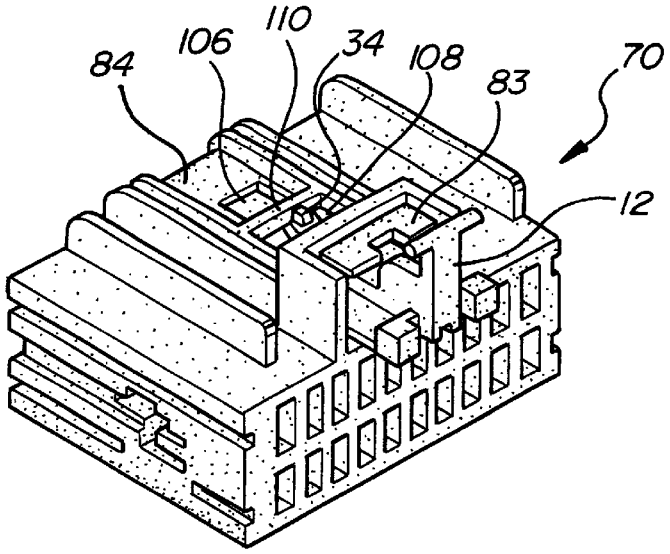
FIG. 2 illustrates the female housing and CPA of FIG. 1 in a CPA pre-set position prior to the female housing being mated with the male housing.
Figure 3:
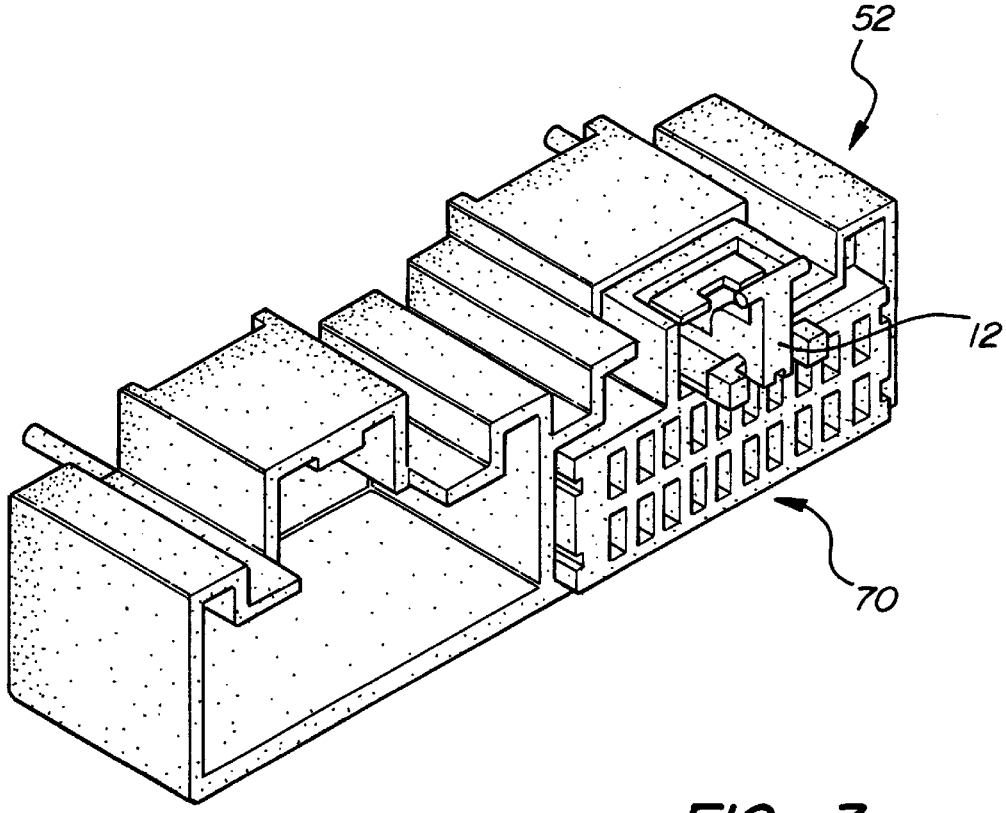
FIG. 3 illustrates the female housing and pre-set CPA mated with the male housing in a pre-locked condition.
Figure 6:
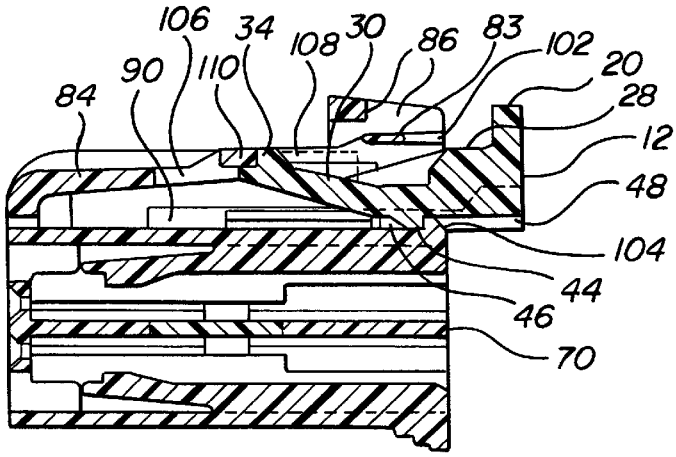
FIG. 6 is a cross-sectional side view of the pre-set CPA combination of FIG. 3.
Figure 6A:
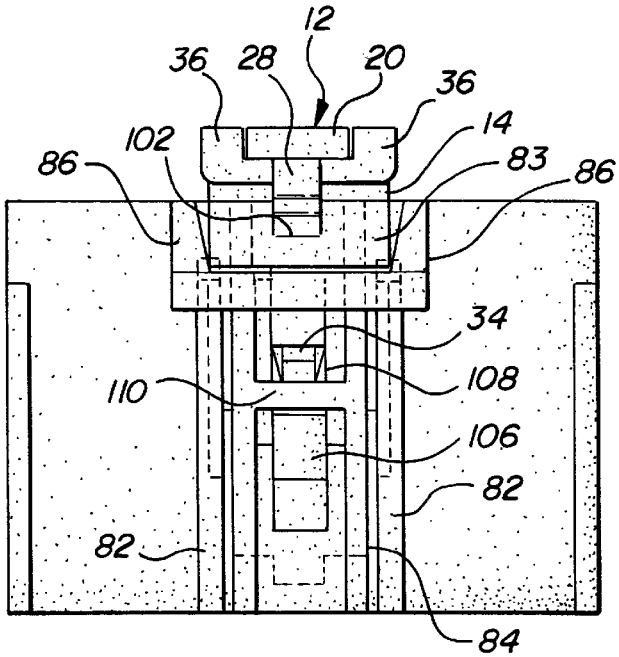
FIG. 6A is a plan view of FIG. 6.
Figure 7:
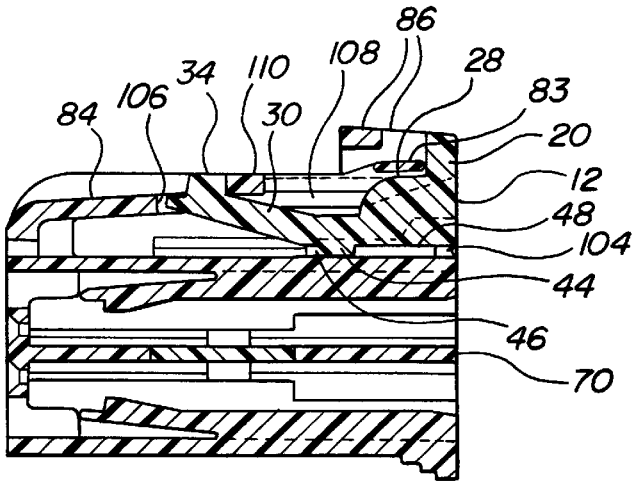
FIG. 7 is a cross-sectional side view of the full-locked CPA combination of FIG. 4 (omitting the male housing for clarity)
Figure 7A:
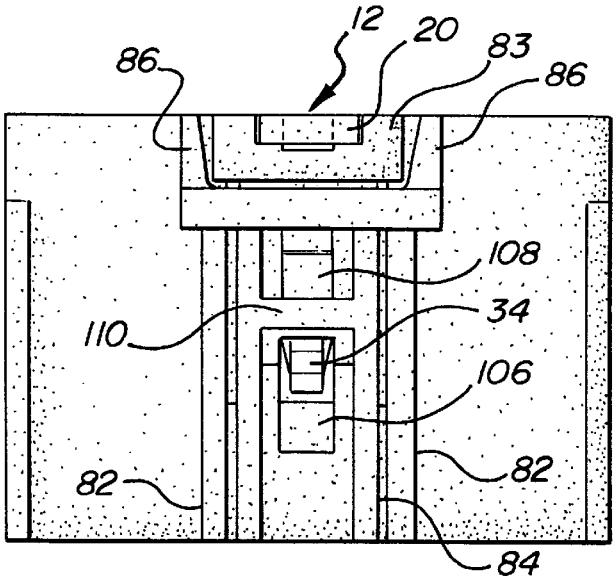
FIG. 7A is a plan view of FIG. 7.
Figure 8:
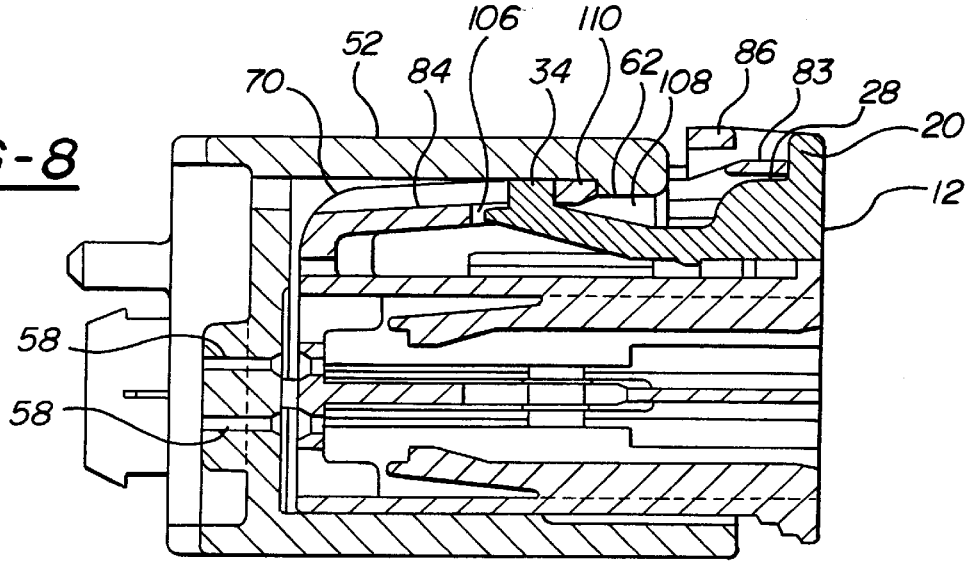
FIG. 8 is a cross-sectional side view of the full-locked CPA combination of FIG. 4 (including the male housing)
Figure 9:
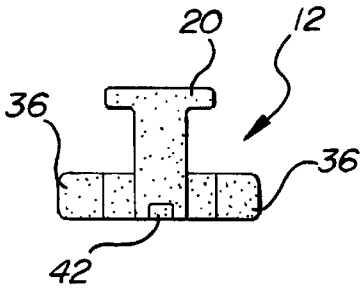
FIG. 9 is a rear elevational view of the CPA.
Figure 10:
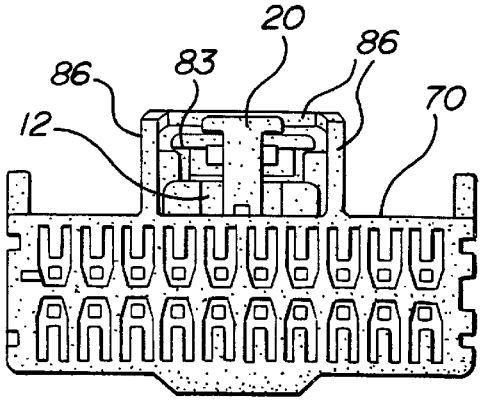
FIG. 10 is a rear elevational view of the CPA fully engaged with the female housing.

The mating engagement between CPA 12 and female housing 70 will now be described. Middle prong 30 and outer guides 38 of the CPA are inserted under the operating tab 83 of lock arm 84 on female housing 70. This is illustrated generally in FIGS. 2 and 3, and in cross-sectional detail in FIGS. 6 and 7. The CPA guide arms 38 slide under internal rails 90 along the inner surfaces of lock arm guides 82. Rails 90 ensure that the CPA is properly positioned. The CPA is pushed forwardly until the pawl 34 on middle prong 30 abuts the rearward edge of bridge portion 110 separating apertures 106 and 108 in the lock arm. Simultaneously, the nub 104 on the top wall 80 of housing 70 is received in the forward part 46 of channel 42 on the underside of the CPA. As the CPA is inserted the forwardly-beveled detent 44 in channel 42 snaps over nub 104. The nub is accordingly in the long part 48 of the channel when pawl 34 abuts bridge portion 110. As a result, the CPA cannot proceed further forward under the lock arm due to the abutment of the pawl against the bridge portion. At this point it also becomes difficult (without significant force) to pull the CPA away from the female housing due to the contact between the rear, flat face of underside channel detent 44 and nub 104, as best depicted in FIG. 6. The CPA is now in a "preset" position on the female housing.

To electrically mate female terminals in female housing 70 with male terminals in male housing 52, the first end 72 of female housing 70 is inserted into the male housing. Alignment buttresses 91 on the top wall 80 of female housing 70 enter mating grooves 91*a* in the upper wall 60 of the male connector housing 52 to properly align and guide the insertion of the female housing. Resistance is encountered when boss 62 on the inner upper wall of the male connector housing passes over first aperture 106 of the lock arm and abuts the bridge portion 110. Additional force is needed to push the bridge portion forwardly under boss 62, with the transition preferably aided by rounded leading edges on boss 62 and beveled, ramp-like leading portions of bridge 110 The boss, as it slides over the bridge portion, deflects lock arm 84 and tab 83 downwardly toward female housing 70, exposing pawl 34. As downwardly-deflected bridge 110 passes forwardly beyond boss 62, the boss contacts pawl 34 and forces the pawl and middle CPA prong 30 downward. Boss 62 then snaps into second aperture 108 on lock arm 84 as bridge 110 and forward aperture 106 snap upwardly on the forward side of the boss. Lock arm 84 and tab 83 now pop back up at the rear of the female housing.

At this point, the female housing 70 and its terminals are completely inserted in and fully mated to the male housing 52 and its terminals. Only in this fully inserted "pre-lock" position, with boss 62 forcing pawl 34 out of the second aperture, and lock arm 84 and tab 83 in the normal up position, can CPA 12 be inserted further under the lock arm.

The CPA 12 is now pushed forwardly into the mated housings. Seat 28 on shoulder 26 of the CPA slides under tab 83 and T-shaped handle 20 enters the notch 102. Pawl 34 simultaneously pops up into the first aperture 106 on lock arm 84 with middle prong 30 hooking the beveled rear edge of pawl 34 against the flat front portion of the bridge 110. This procedure preferably ends with an audible and felt snap or click. The CPA is now "full-locked".

Since the CPA can only be fully inserted after the connector housings are completely mated, the full-locked CPA provides a visual and tactile indication of complete connector mating, assuring electrical connection of the terminals.

In the fill-locked position the CPA also reinforces the locking connection between the housings. Seat 28 on the CPA prevents tab 83 of the lock arm from being pushed downward and releasing the locked housings. The T-shaped crossbar on handle 20 projection shields the upper surface of tab 83, and well 86 surrounds the tab on three sides, thereby cooperating to prevent foreign objects from impacting the tab and accidentally releasing the lock arm.

The crossbar also makes the CPA easier to deliberately remove when separation of the housings is desired. A fingertip or fingernail is placed between the crossbar and well 86 and force is applied rearwardly against the CPA, pulling it straightaway from the female housing, thereby forcing pawl 34 back under the bridge portion 110 on lock arm 84. However, underside channel detent 44 on the CPA then abuts nub 104 on the female housing, preventing complete separation of the CPA and female housing unless further, significant force is applied in an arcuate upward and outward direction.

With the CPA removed, a fingertip or fingernail can then be pressed against the tab to force it downward and release lock arm 84 from male housing 52. The female housing can then be removed from the male housing.

It will be understood by those skilled in the art that the foregoing is an illustrative example of a preferred embodiment, but is not intended to limit the invention to the particular structure disclosed. For example, the overall shape, size, and geometry of the housings and CPA element can vary within reasonable parameters and still lie within the scope of the invention. The shapes and positions of various detents can vary. The size, shape, and number of terminals of the respective male and female housings can vary. The materials used for the male and female housings in the CPA element can vary, although they will generally be formed from readily-molded plastics. The various guides for aligning the male and female housings and the CPA for proper insertion in one another are also subject to change and are not critical to the invention.

Since those and other minor changes and modifications varied to fit particular operating requirements and environments will be understood by those skilled in the art, this invention is not considered limited to the specific examples chosen for purposes of illustration. The invention is meant to include all changes and modifications which do not constitute a departure from the true spirit and scope of this invention as claimed in the following claims and as represented by reasonable equivalents to the claimed elements.

What is claimed is:

1. A connector assembly comprising:

a first connector housing having an open end, an inner cavity and a locking protrusion extending from an upper wall into the inner cavity;

a second connector housing having a top wall and a flexible lock arm extending along the top wall, the second connector housing and lock arm being sized to be received in the inner cavity of the first connector housing, the lock arm having a locking aperture for receiving the locking protrusion when the second connector housing is fully inserted in the first connector housing, the lock arm further having a free end terminating in a release tab which remains outside the first connector housing when the second connector housing is fully inserted in the first connector housing, the release tab being in a raised position when the locking protrusion on the first connector housing is in the locking aperture on the lock arm, the release tab capable of being depressed so as to move the lock arm downwardly and disengage the locking aperture from the locking protrusion; and an assurance element adapted to be inserted between the top wall and lock arm to a preset position and adapted to be fully inserted between the top wall and lock arm to a fully locked position, the assurance element including a seat adapted to be positioned under the release tab to prevent the release tab from being depressed so as to disengage the locking aperture from the locking protrusion when the second connector housing is fully inserted in the first connector housing and the assurance element is fully inserted between the top wall and lock arm.

2. A connector assembly according to claim 1 wherein the assurance element includes a deflectable arm having a free end with a pawl, the pawl abutting an insertion-preventing portion of the lock arm when the assurance element is inserted to the preset position to block full insertion of the assurance element between the top wall and lock arm.

3. A connector assembly according to claim 2 wherein the assurance element further includes a base portion from which said deflectable arm extends, the base portion having an underside adapted to rest on the top wall of the second connector housing, the underside further having a channel and a barrier dividing the channel, the top wall of the second connector housing having a protuberance adapted to be received in said channel and to abut one side of the barrier to block the assurance element from being withdrawn from between the top wall and lock arm in the pre-set position.

4. A connector assembly according to claim 2 wherein the insertion-preventing portion is a bridge portion between the locking aperture and an assurance aperture in the lock arm, whereby the pawl is located in the locking aperture and presses against one side of the bridge portion in the pre-set position of the assurance element and is located in the assurance aperture and hooked against an opposite side of the bridge portion when the assurance element is fully inserted.

5. A connector assembly according to claim 4 wherein the assurance element further includes a stem extending through a portion of the release tab and a crossbar on the stem above the release tab.

6. A connector assembly according to claim 5 wherein the top wall of the second connector housing includes a well surrounding the release tab on three sides, whereby the well and the crossbar protect the release tab from inadvertent forces tending to release the lock member.

7. A connector assembly according to claim 5 wherein the release tab has a notch for receiving the stem when the assurance element is in the fully inserted position, whereby the crossbar overlies a portion of the release tab.

8. A connector position assurance element comprising:

a horizontal base portion having an insertion end and a withdrawal end;

a stem extending vertically from the withdrawal end of the base portion;

a finger-graspable crossbar on an end of the stem distal from the base portion;

a deflectable arm extending from the withdrawal end of the base portion at an upward acute angle and terminating in a free end adjacent and above the insertion end; and, a shoulder located between the stem and the deflectable arm, the shoulder defining a horizontal seat above the base portion and below the crossbar.

9. A connector position assurance element according to claim 8 wherein at least a portion of the arm is curved upwardly toward its free end.

10. A connector position assurance element according to claim 8 further comprising a pawl on the free end of the arm extending in an upward direction.

11. A connector position assurance element according to claim 8 wherein the base portion has an underside and a channel extending along the underside from the withdrawal end toward the insertion end.

12. A connector position assurance element according to claim 11 wherein the channel is divided into two parts by a barrier across the channel.

13. A connector assembly comprising:

a first connector housing having an open end, an inner cavity and a locking protrusion extending from an upper wall into the inner cavity adjacent the open end;

a second connector housing having a top wall and a flexible, cantilevered lock arm extending along the top wall from an insertion end toward a withdrawal end, the second connector housing and lock arm being sized to be received in the inner cavity of the first connector housing, the lock arm further including a locking aperture for receiving the locking protrusion when the second connector housing and lock arm are fully inserted in the first connector housing, the lock arm further including a finger-operable release tab at the withdrawal end of the second connector housing, the release tab remaining outside the inner cavity when the second connector housing and lock arm are fully inserted in the first connector housing;

an assurance element adapted to be inserted between the top wall and lock arm from the withdrawal end of the second connector housing, the assurance element including a portion adjacent its withdrawal end adapted to rest under and block downward movement of the finger-operable tab, and a raised, deflectable arm adjacent its insertion end adapted to engage the lock arm in an insertion-preventing and withdrawal-hindering pre-set position when the assurance element is inserted partway underneath the lock arm and prior to the tab-blocking portion arriving under the finger-operable tab, the deflectable arm further being adapted to be moved out of the insertion-preventing, withdrawal-hindering pre-set position by the locking protrusion on the first connector when the second connector housing is inserted in the inner cavity of the first connector to the fully inserted position thereby defining a pre-locked position, the deflectable arm further being adapted to engage the lock arm in a fully locked position when the assurance element is inserted fully under the lock arm with the tab-blocking portion resting under the finger-operable tab.

* * * * *